United States Patent [19]

Hewitt

[11] 4,118,115

[45] Oct. 3, 1978

[54] DEVELOPER ROLL DRIVE

[75] Inventor: Robert E. Hewitt, Ontario, N.Y.

[73] Assignee: Xerox Corporation, Stamford, Conn.

[21] Appl. No.: 778,906

[22] Filed: Mar. 18, 1977

[51] Int. Cl.[2] ..... G03G 15/00

[52] U.S. Cl. ..... 355/3 DD; 118/657

[58] Field of Search ..... 355/3 DD; 118/657, 656; 427/18

[56] References Cited

U.S. PATENT DOCUMENTS 4,034,709 7/1977 Fraser et al. ..... 355/3 DD

*Primary Examiner*—Richard L. Moses

*Attorney, Agent, or Firm*—J. J. Ralabate; C. A. Green; H. Fleischer

[57] ABSTRACT

An apparatus in which a latent image arranged to be recorded on a surface is rendered visible with particles. The drive system associated with moving the particles into contact with the latent image has at least a portion thereof mounted internally of the particle supporting member.

8 Claims, 4 Drawing Figures

DEVELOPER ROLL DRIVE

BACKGROUND OF THE INVENTION

This invention relates generally to an electrostatographic printing machine, and more particularly concerns an improved development system for use therein.

An electrostatograhic printing process involves the recordation of electrostatic latent charge patterns and the reproduction thereof in viewable form. The field of electrostatography includes electrophotography and electrography. Electrophotography is that class of electrostatography which employs a photosensitive medium to form, with the aid of electromagnetic radiation, the electrostatic latent charge pattern. Electrography is that class of electrostatography which utilizes an insulating medium to form, without the aid of electromagnetic radiation, the electrostatic charge pattern. Hereinafter, an electrophotographic printing machine will be described as an illustrative embodiment of these processes.

In the process of electrophotographic printing, a photoconductive member is charged to a substantially uniform level and exposed to a light image of an original document being reproduced. The light image discharges the photoconductive member in the irradiated areas to record an electrostatic latent image thereon. Thereafter, charged particles are attracted to the latent image so as to form a powder image on the photoconductive surface. The powder image is then transferred to a sheet of support material, i.e. the copy sheet, in image configuration. The powder image adhering to the copy paper is heated permanently affixing it thereto. This process is more fully described in U.S. Pat. No. 2,297,691 issued to Carlson in 1942, and further exemplified by many other related patents in the art.

The act of depositing charged particles on the electrostatic latent image is termed development. Development is employed in all of the aforementioned classes of electrostatography. In electrophotographic printing, the electrostatic latent image recorded on the photoconductive member is brought into contact with a developer mix. Typically, the developer mix comprises dyed or colored thermoplastic powders, known in the art as toner particles, which are mixed with coarser carrier granules, such as ferro-magnetic granules. The toner particles and carrier granules are selected such that the toner particles acquire the appropriate charge relative to the electrostatic latent image recorded on the photoconductive surface. When the developer mix is brought into contact with the charged photoconductive surface, the greater attractive force of the electrostatic latent image recorded thereon causes the toner particles to transfer from the carrier granules and adhere to the electrostatic latent image.

Recently, single component developer materials have been developed. These are carrierless magnetic particles which are attracted from the developed unit to the electrostatic latent image recorded on the photoconductive surface. U.S. Pat. No. 3,909,258 issued to Kotz in 1975 discloses a development system employing single component magnetic toner particles. Similarly, U.S. Pat. No. 2,846,333 issued to Wilson in 1958 describes a magnetic brush developer unit which utilizes single component magnetic particles. Finally, U.S. Pat. No. 3,563,734 issued to Shely in 1971 discloses the utilization of conductive magnetic particles employed in a magnetic brush developer unit for rendering visible a charge pattern recorded on a surface. However, systems of this type are not maintenance free.

In order to design a system which would be substantially free of maintenance, the magnetic member must be completely isolated from the toner laden environment in which it must function. More particularly, the bearings on supporting the rotating member must be isolated from the particles developing the latent image. Standard techniques for sealing the bearings are generally inappropriate inasmuch as they generally permit small particles, i.e. about 2 microns in size, to contaminate the bearings. Alternatively, if sufficient grease is packed into the bearings to exclude foreign material therefrom, the grease may seep from the seal contaminating the particles and causing other system problems. Tight fitting seals are another option, however, they significantly increase the torque and wear of the system. Thus, seals of this type are not highly desirable. An additional requirement of this type of development system is that the gap between the donor roll supporting the particles and the photoconductive member must remain substantially constant. One solution to this problem has been to have the particle support donor roll ride on the photoconductive member. This imposes another constraint on the system. The drive system must move or be coupled flexible to the supporting donor roll when the supporting donor roll moves laterally to track the out of round condition of the photoconductive member.

Accordingly, it is a primary object of the present invention to improve the donor roll employed in the development system of an electrophotographic printing machine by eliminating external moving parts.

SUMMARY OF THE INVENTION

Briefly stated, and in accordance with the present invention, there is provided an apparatus for rendering visible a latent image arranged to be recorded on a surface with particles.

Pursuant to the features of the present invention, there is provided means for depositing particles onto the latent image recorded on the surface. Means, having at least a portion thereof mounted internally of the depositing means, is provided for moving the particles into communication with the latent image.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
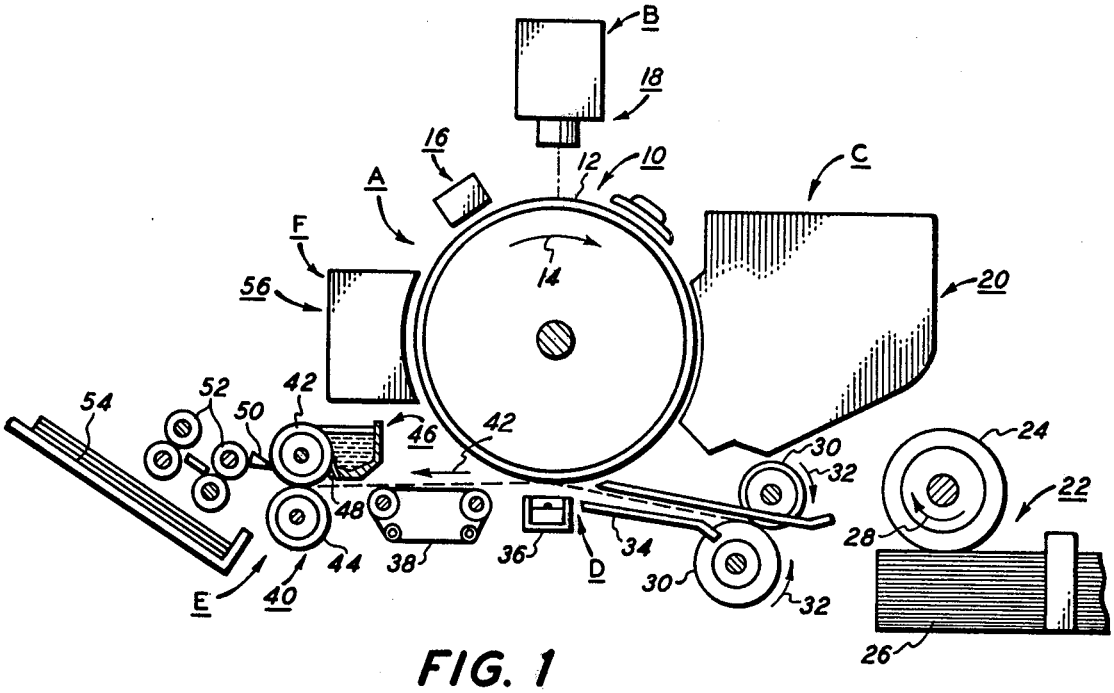
FIG. 1 depicts schematically, in elevation, an electrophotographic printing machine incorporating the features of the present invention therein.

With continued reference to the drawings wherein like reference numerals have been used throughout to designate identical elements, FIG. 1 illustrates an electrophotographic printing machine incorporating the features of the present invention therein. Although the development apparatus of the present invention is particularly well adapted for use in the FIG. 1 electrophotographic machine, it should become evident from the following discussion that it is equally well suited for use in a wide variety of electrostatographic printing machines and is not limited in its application to the particular embodiment shown herein.

Referring now to FIG. 1, there is shown schematically the various components of the electrophotographic printing machine adapted to employ the features of the present invention therein. As shown in FIG. 1, the printing machine includes a drum 10 having a photoconductive surface 12 secured to and entrained about an aluminum substrate. A synchronous speed motor (not shown) rotates drum 10 in the direction of arrow 14. As drum 10 rotates, a portion of photoconductive surface 12 passes sequentially through a series of processing stations. These processing stations will be described hereinafter briefly.

Initially, a portion of photoconductive surface 12 passes through charging station A. At charging station A, a corona generating device, designated generally by the reference numeral 16, sprays ions onto photoconductive surface 12. This charges photoconductive surface 12 to a substantially uniform level. Thereafter, the charged portion of photoconductive surface 12 is rotated to exposure station B.

At exposure station B, exposure mechanism 18 projects a light image of the original document being reproduced onto the charged portion of photoconductive surface 12. Exposure mechanism 18 includes a stationary housing for supporting an original document. The housing comprises a transparent platen upon which the original document is positioned. Lamps illuminate the original document. Scanning of the original document is achieved by oscillating a mirror in a timed relationship with the movement of drum 10, or, in lieu thereof, by moving the lamp and lens system to form a flowing light image thereof. The light image of the original document is projected onto the charged portion of photoconductive surface 12. In this manner, photoconductive surface 12 is selectively irradiated so as to dissipate the charge thereon and record an electrostatic latent image corresponding to the informational areas contained within the original document.

Next, the electrostatic latent image recorded on photoconductive surface 12 is rotated to development station C. At development station C, a developer unit 20 has a housing with a supply of developer material contained therein to render the electrostatic latent image visible. The detailed structure of the developer unit will be described hereinafter with reference to FIGS. 2 through 4, inclusive. Typically, the developer material is a two-component mixture of ferro-magnetic carrier granules and thermo-plastic toner particles. However, in the alternative, a single component magnetic material may be employed, e.g. uncharged insulating magnetic particles. Generally, these particles have a resistivity ranging from about $10^{14}$ to about $10^{17}$ ohm-cm. By way of example, particles of this type may be formed from magnetic material, i.e. a core, having an insulating coating thereon. The developer material is brought through a directional flux field forming a brush thereof. The electrostatic latent image on photoconductive surface 12 attracts the particles from the development system to form a powder image on photoconductive surface 12.

After development, a corona generating device (not shown) sprays ions onto the particles. This pre-conditions the particles preparatory to their being transferred to a sheet of support material, i.e. the copy sheet.

Referring now briefly to the sheet feeding path, a sheet of support material is advanced by sheet feeding apparatus 22 to transfer station D. Sheet feeding apparatus 22 includes a feed roll 24 contacting the uppermost sheet of the stack of support material 26. Feed roll 24 rotates in the direction of arrow 28 to advance the uppermost sheet from stack 26. Registration rollers 30, rotating in the direction of arrow 32, align and forward the advancing sheet of support material into chute 34. Chute 34 directs the advancing sheet of support material into contact with drum 10 in a timed relationship so that the powder image developed thereon contacts the advancing sheet of support material at transfer station D.

Transfer station D includes a corona generating device, indicated generally by the reference numeral 36, for spraying ions onto the backside of the sheet of support material, i.e. the side opposed from drum 10. The powder image adhering to drum 10 is then attracted therefrom to the surface of the sheet of support material in contact therewith. After transferring the powder image to the sheet of support material, endless belt conveyer 38 advances the sheet of support material to fixing station E.

Fixing station E includes a fuser assembly, indicated generally by the reference numeral 40. The sheet of support material advances in the direction of arrow 42 into a nip defined by fuser roller 44 and backup roller 46 of fuser assembly 40. Fuser roller 44 is preferably heated with the sheet of support material having the powder image thereon in contact therewith. A release material applicator 48 supplies release material to fuser roller 44. The powder image formed on the sheet of support material is heated by fuser roller 44 so as to permanently affix it thereto. After the fusing process, rollers 52 advance the sheet of support material with the powder image permanently affixed thereto to catch tray 54 for subsequent removal therefrom by the machine operator.

Invariably, residual toner particles remain adhering to drum 10 after the transfer of the powder image to the sheet of support material. Cleaning station F includes a pre-clean corona generating device (not shown) which sprays ions onto the particles so as to substantially neutralize the charge thereon. Thereafter, a rotatably mounted fibrous brush in contact with photoconductive surface 12 removes the residual particles therefrom. Photoconductive surface 12 is returned to its initial charge level by illuminating the surface thereof with light rays.

Figure 2:
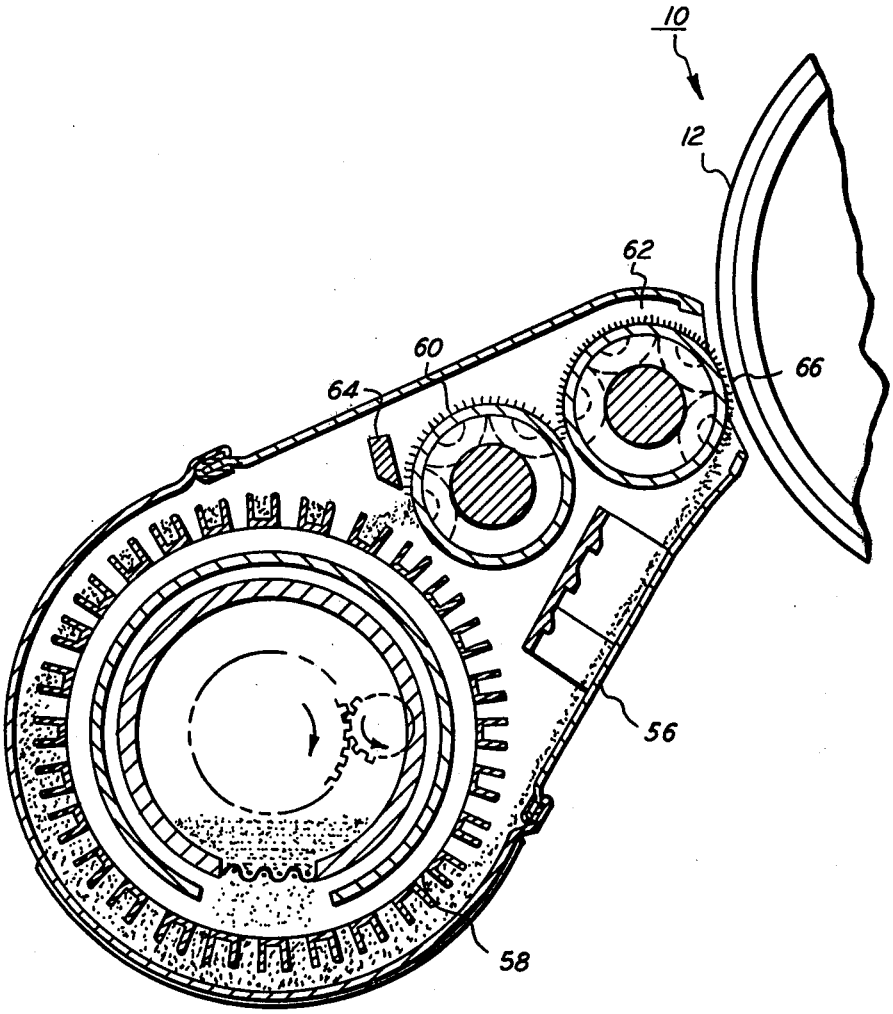
FIG. 2 shows schematically, partially in section, a development system employed in the FIG. 1 printing machine.

Referring now to FIG. 2, there is shown the principle components of developer unit 20. Developer unit 20 includes a developer housing 56, a paddle wheel 58, transport roller 60, and donor roller 62. Paddle wheel 58 is a cylindrical member with buckets or scoops disposed about the periphery thereof. It is adapted to rotate so as to elevate the developer material from the lower region of housing 56 to the upper region thereof. When the developer material reaches the upper region of housing 56, it is lifted from the paddle wheel buckets to transport roller 60. As the developer material in the paddle wheel buckets approaches transport roller 60, the magnetic fields produced by the magnets therein attract the developer material thereto. Transport roller 60 moves the developer material in an upwardly direction to donor roller 62. A surplus of developer material is furnished and metering blade 64 is provided to control the amount of developer mix carried over the top of transport roller 60. The surplus developer material is sheared from transport roller 60 and falls in a downwardly direction toward paddle wheel 56. As the surplus developer material descends, it falls into the lower regions of developer housing 56 and is mixed with the remaining developer material contained therein.

The developer material which passes metering blade 64 is carried over transport roller 60 to donor roller 62 and into development zone 66. Development zone 66 is located between photoconductive surface 12 and donor roller 62. The electrostatic latent image recorded on photoconductive surface 12 is developed by contacting the moving developer material. The charged areas of photoconductive surface 12 electrostatically attract the particles thereto. After the electrostatic latent image recorded on photoconductive surface 12 is developed, development action is discontinued. This may be achieved by de-energizing transport roller 60 so that additional developer material is no longer supplied to donor roller 62.

Figure 3:
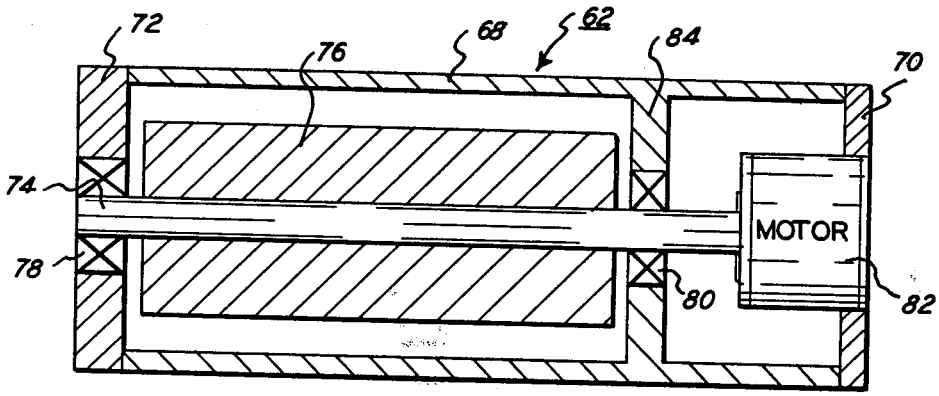
FIG. 3 illustrates a schematic fragmentary sectional view of one embodiment of the donor roll used in the FIG. 2 development system.

Turning now to FIG. 3, the detailed structure of one embodiment of donor roller 62 will be described hereinafter. As shown therein, donor roller 62 includes a nonmagnetic stationary tubular member 68, preferably made from aluminum. End caps 70 and 72, respectively, seal tubular member 68. A shaft 74 made preferably of steel is concentrically mounted within tubular member 68 and serves as a rotatable mounting for magnetic member 76. Magnetic member 76 preferably comprises magnets made of barium ferrite in the form of an elongated cylindrical member having the poles impressed about the circumferential surface thereof. Roller bearings 78 and 80, respectively, support shaft 74 rotatably. A synchronous speed motor 82 drives shaft 74. Thus, magnetic member 76 rotates relative to stationary tubular member 68 at a substantially constant angular velocity. The rotating magnetic member advances the developer material on the surface of tubular member 68 into development zone 66. Tubular member 68 includes an inwardly directed flange 84 for supporting bearings 80. Magnetic member 76 is secured fixedly to shaft 74 which is driven by motor 82 to rotate relative to stationary tubular member 68. End caps 70 and 72 securely seal the interior of tubular member 68 so as to prevent contamination thereof.

Figure 4:
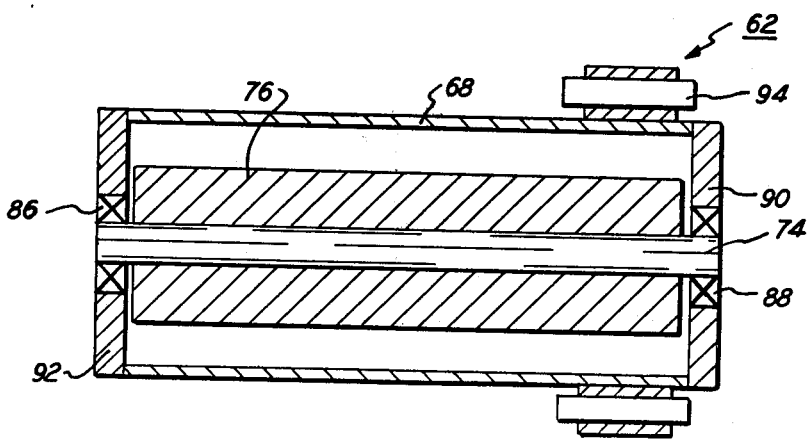
FIG. 4 depicts a schematic fragmentary sectional plan view of another embodiment of the donor roll utilized in the FIG. 2 development system.

Referring now to FIG. 4, an alternative embodiment of donor roller 62 is depicted thereat. Donor roller 62 includes a steel shaft 74 mounted rotatably on roller bearings 86 and 88. Bearings 86 and 88 are mounted in end caps 92 and 90, respectively. End caps 92 and 90 are secured to opposed ends of tubular member 68 sealing the interior thereof. As shown in FIG. 4, magnetic member 76 is an elongated cylindrical member pressed onto shaft 74. Preferably, magnetic member 76 is made from barium ferrite and has a plurality of poles impressed about the periphery thereof, i.e. equally spaced poles. Tubular member 68 is telescopically interfit over magnetic member 76. Bearings 86 and 88 provide a rotatable support for shaft 74. Thus, rotation of shaft 74 rotates magnetic member 76 therewith. Tubular member 68 remains substantially stationary. End caps 90 and 92 enclose the interior of tubular member 68 preventing contamination thereof. By way of example, end caps 92 and 90 may threadedly engage tubular member 68, or, in lieu thereof, may be fastened thereto by suitable bolts. Motor stator 94 is pressed onto the exterior circumferential surface of tubular member 68 at one end region thereof opposed from the corresponding end region of magnetic member 76. Thus, excitation of stator 94 causes magnetic member 76 to rotate. Rotation of magnetic member 76 relative to stationary tubular member 68 moves the developer material into development zone 66.

From the foregoing, it is apparent that the development system of the present invention includes a donor roller having the drive mechanism at least partially mounted interiorly thereof. This enables the interior of the donor roller and the bearing supports therefor to be encapsulated preventing contamination thereof. The foregoing substantially increases the life of the development system.

It is, therefore, evident that there has been provided in accordance with this invention, an apparatus for developing an electrostatic latent image that fully satisfies the objects, aims and advantages hereinbefore set forth. While this invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An apparatus for rendering visible a latent image arranged to be recorded on a surface with particles, including:

means for holding the particles;

means for securing releasably the particles to said holding means; and means, having at least a portion thereof mounted internally of said holding means, for moving said securing means to advance the particles into communication with the latent image recorded on the surface depositing at least a portion of the particles thereon.

2. An apparatus as recited in claim 1, wherein:

said holding means includes a tubular member; and said securing means includes a magnetic member disposed within said tubular member for creating a magnetic field about at least a portion of the periphery of said tubular member to attract magnetically the particles to the surface of said tubular member.

3. An apparatus for rendering visible a latent image arranged to be recorded on a surface with particles, including:

a magnetic member;

a tubular member interfit telescopically over said magnetic member;

a rotatably mounted shaft having said magnetic member mounted fixedly thereon with said tubular member being mounted stationarily; and a drive motor mounted internally of said tubular member and coupled to said shaft for rotating said magnetic member to advance the particles about the periphery of said tubular member into communication with the latent image recorded on the surface.

4. An apparatus for rendering visible a latent image arranged to be recorded on a surface with particles, including:

a magnetic member;

a tubular member interfit telescopically over said magnetic member;

a rotatably mounted shaft having said magnetic member mounted fixedly thereon with said tubular member being mounted stationarily, said magnetic member includes an elongated cylindrical member mounted on said shaft and extending the length of said tubular member; and a stator mounted externally of said tubular member in the region of one end portion thereof and electrically coupled to the portion of said cylindrical member opposed therefrom for rotating said cylindrical member relative to said tubular member to advance the particles about the periphery of said tubular member into communication with the latent image recorded on the surface.

5. An electrophotographic printing machine of the type having an electrostatic latent image arranged to be recorded on a photoconductive member, wherein the improved development apparatus includes:

means for holding the particles;

means for securing releasably the developer material to said holding means; and means having at least a portion thereof mounted internally of said holding means, for moving said securing means to advance the developer material into communication with the electrostatic latent image recorded on the photoconductive member.

6. A printing machine as recited in claim 5, wherein:

said holding means includes a tubular member; and said securing means includes a magnetic member disposed within said tubular member for creating a magnetic field about at least a portion of the periphery of said tubular member to attract magnetically the developer material to the surface of said tubular member.

7. An electrophotographic printing machine of the type having an electrostatic latent image arranged to be recorded on a photoconductive member, wherein the improved development apparatus includes:

a magnetic member;

a tubular member interfit telescopically over said magnetic member;

a rotatably mounted shaft having said magnetic member mounted fixedly thereon with said tubular member being mounted stationarily; and a drive motor mounted internally of said tubular member and coupled to said shaft member for rotating said magnetic member to advance the developer material about the periphery of said tubular member into communication with the electrostatic latent image recorded on the photoconductive member.

8. An electrophotographic printing machine of the type having an electrostatic latent image arranged to be recorded on a photoconductive member, wherein the improved development apparatus includes:

a magnetic member;

a tubular member interfit telescopically over said magnetic member;

a rotatably mounted shaft having said magnetic member mounted fixedly thereon with said tubular member being mounted stationarily, said magnetic member includes an elongated cylindrical member mounted on said shaft and extending substantially the length of said tubular member; and a stator mounted externally of said tubular member in the region of one end portion thereof and electrically coupled to the portion of said cylindrical member opposed therefrom for rotating said cylindrical member relative to said tubular member to advance the developer material about the periphery of said tubular member into communication with the electrostatic latent image recorded on the photoconductive member.

* * * * *